US005921632A

United States Patent [19]

LeBegue

[11] Patent Number: 5,921,632

[45] Date of Patent: Jul. 13, 1999

[54] METHOD AND APPARATUS FOR EXTENDING THE CUTTER DRUM OF A BORING MACHINE

[75] Inventor: Maurice K. LeBegue, Bluefield, W. Va.

[73] Assignee: Eimco Coal Machinery Incorporated, Bluefield, W. Va.

[21] Appl. No.: 08/887,069

[22] Filed: Jul. 2, 1997

[51] Int. Cl.[6] ..... E21C 27/24

[52] U.S. Cl. ..... 299/80.1; 299/59

[58] Field of Search ..... 299/57, 59, 80.1

[56] References Cited

U.S. PATENT DOCUMENTS

| | | | |
|---|---|---|---|
| 3,041,054 | 6/1962 | Ball | 299/57 |
| 3,157,437 | 11/1964 | Gonski | 299/71 |
| 3,309,143 | 3/1967 | Karlovski, Jr. et al. | 299/57 |
| 3,318,638 | 5/1967 | Kilbourne | 299/80.1 X |
| 3,325,218 | 6/1967 | Kirkpatrick | 299/31 |
| 3,339,982 | 9/1967 | Karlovski, Jr. et al. | 299/57 |
| 3,341,254 | 9/1967 | Arndt | 299/18 |
| 3,515,217 | 6/1970 | Jamison | 169/47 |
| 3,712,679 | 1/1973 | Amoroso | 299/76 |
| 3,730,593 | 5/1973 | Karlovski, Jr. | 299/76 |
| 3,774,969 | 11/1973 | LeBegue | 299/76 |
| 3,844,618 | 10/1974 | Delli-Gatti, Jr. | 299/64 |
| 4,003,602 | 1/1977 | Justice et al. | 299/18 |
| 4,076,316 | 2/1978 | LeBegue | 299/64 |
| 4,082,362 | 4/1978 | Justice et al. | 299/57 |
| 4,339,153 | 7/1982 | LeBegue et al. | 299/59 |
| 4,341,424 | 7/1982 | Wilcox, Jr. et al. | 299/57 |
| 4,813,749 | 3/1989 | Cilles | 299/80.1 |
| 4,889,392 | 12/1989 | Justice et al. | 299/18 |

*Primary Examiner*—David J. Bagnell
*Attorney, Agent, or Firm*—Price & Adams

[57] ABSTRACT

A self-propelled boring type mining machine includes a mobile frame and a pair of spaced apart rotor drive shafts extending forwardly from the mobile frame. Rotary cutter arms are nonrotatably connected to the rotor drive shafts for cutting a pair of overlapping bores in a mine face to dislodge solid material. Cusps formed at the mine roof and floor are dislodged by upper and lower cutter drum assemblies pivotally mounted transversely on the frame front end portion. The lower cutter drum assembly includes an intermediate drum section separated by gaps from a pair of end drum sections. Gear cases extend into the gaps to rotatably support a transverse drive shaft that is drivingly connected to the intermediate and end drum sections. The centerlines of the gear cases are spaced inboard of the centerlines of the rotor drive shafts. The end drum sections are helically splined to the drive shaft so that upon rotation of the drive shaft, the end drum sections rotate and advance longitudinally on the drive shaft between a retracted position and an extended position to control the width of cut in the mine face. By positioning the gear cases inboard of the rotor drive shafts when the end drum sections are extended the area left uncut between the cutting paths of the rotary cutter arms and end drum sections is minimized.

20 Claims, 9 Drawing Sheets

METHOD AND APPARATUS FOR EXTENDING THE CUTTER DRUM OF A BORING MACHINE

BACKGROUND OF THE INVENTION

1. Field of the Invention

This invention relates to a cutter drum assembly for use on a boring type mining machine and, more particularly to a cutter drum having extensible end drums for expanding the cutting width of the cutter drum to dislodge solid material left uncut by the rotor cutter arms from a mine face at the mine roof and floor.

2. Description of the Prior Art

Boring machines for underground mining operations are well known in the art as illustrated in U.S. Pat. Nos. 3,041,054; 3,309,143; 3,325,218; 3,339,982; 3,515,217; 4,339,153; and 4,889,392. Typically, these types of boring machines utilize parallel interlaced rotor arms having cutting elements which cut a generally oval-shaped entry in the mine. Cutter chains or continuous cutter drums are utilized at the roof and floor levels to trim or eliminate cusps left in place because they are out of the cutting paths of the rotor arms. The cutter chain or drum at the mine floor is also used to increase the width of the cut in the mine entry.

To facilitate tramming of the machine into and out of position opposite of the mine face, the lower cutter chain or drum is retracted out of contact with the mine sidewalls and raised out of contact with the mine floor. The upper cutter chain or drum is lowered out of contact with the mine roof.

To increase the width of the cut at the mine floor beyond the cutting path of the rotor arms, it is necessary to extend the width of the lower cutter drum once its lowered into position on the mine floor at the base of the mine face. U.S. Pat. Nos. 3,730,593, 3,774,969, and 4,076,316 disclose the concept of extending the length of a cutter drum assembly on continuous mining machines.

U.S. Pat. Nos. 3,730,593 and 3,774,969 each disclose a continuous mining machine having a cutter drum assembly rotatably mounted on a forwardly extending boom member. A plurality of cutter bits extend outwardly from the drum member. The drum member includes intermediate drum sections and a pair of end drum sections. The intermediate and end drum sections are telescopically mounted to extend the length of the drum assembly beyond the width of the machine. Extension of the end drum sections is accomplished by lateral movement of a boom member having arm members which rotatably support end drum sections. The lateral movement is generated by hydraulic piston cylinder assemblies that exert lateral pressure on the boom arms.

U.S. Pat. No. 4,076,316 also discloses a continuous mining machine having a forwardly extending boom assembly pivotally secured to the frame of the mining machine. The boom assembly includes a pair of parallel forwardly extending arm members that are pivotally connected to the mining machine body portion. A pair of parallel support members are movably secured to and extend laterally from the respective arm members. A cutter drum is rotatably supported at the forward end portions of the support members. A pair of cylinder assemblies are secured to respective arm members and each includes an extensible cylinder rod secured to a support member. Actuating the cylinder assemblies extends the end drum sections laterally away from an intermediate drum section. The end drum sections are independently extendable to increase gathering efficiency.

The known prior art drum extension mechanisms utilize hydraulic cylinder assemblies to both initially extend the cutter drum end portions and maintain them in an extended position. The continuous pressure exerted on the hydraulic mechanisms accelerates wear of the seal components necessitating increased maintenance demands.

In dual rotor boring machines, a lower cutter drum assembly trims material at the mine floor left uncut by the rotor arms. Typically, the cutter drum includes a center or intermediate drum section and a pair of end drum sections separated from the intermediate drum section by gear cases. The gear cases rotatably support the respective cutter drum sections.

In a dual rotor assembly, each gear case is positioned below and centered on a rotor axis. With this arrangement, when the end drums are extended to increase the length of the lower cutter drum to increase the width of cut, gaps are formed in the cutting paths between the extended end drums and the rotor arms. This leaves uncut material or cusps projecting upwardly from the mine floor at the mine face.

An alternative prior art arrangement includes each drum section having a fixed portion and an outer extensible portion. The outer portions are extended from the end drum fixed portions to increase the width of cut. However, this requires that in a retracted position the cutting elements on the end drum outer portions interlace with the cutting elements on the end drum fixed portions. This arrangement complicates the structure of the end drum section because of the limited length of the end drum section.

While it is known to extend the length of a cutter drum assembly on a continuous mining machine, there is a need for an extensible lower cutter drum assembly on a boring type mining machine that reduces the wear on the hydraulic seal components of the extension device to extend the operating life of the seal components. Furthermore, the lower cutter drum assembly must be operable in both retracted and extended positions to combine with the rotor arms in completely dislodging the mine material at the mine floor as the machine advances the mine face.

SUMMARY OF THE INVENTION

In accordance with the present invention, there is provided a mining machine that includes a mobile frame. The mobile frame has a front end portion. A rotor assembly includes a plurality of rotor cutter arms rotatably mounted in spaced relation across the frame front end portion. A cutter drum assembly is positioned forwardly of the frame front end portion and extends the width of the frame below the rotor assembly. The cutter drum assembly includes an intermediate drum section and a pair of end drum sections. A drive shaft is rotatably mounted transversely on the frame front end portion. The intermediate drum section and the pair of end drum sections are positioned on the drive shaft. The end drum sections are drivingly connected to the drive shaft for rotation of the end drum sections with the drive shaft. The end drum sections are moved longitudinally on the drive shaft by rotation of the drive shaft to extend the length of the cutter drum assembly.

Further in accordance with the present invention, there is provided a method for extending the length of a cutter drum assembly on a mining machine that includes the steps of rotatably supporting a drive shaft transversely on a front end of the mining machine. An intermediate cutter drum section is mounted between a pair of end cutter drum sections on the drive shaft. The intermediate cutter drum section and the end cutter drum sections are drivingly connected to the drive shaft. Rotation is transmitted from the drive shaft to the intermediate cutter drum section and the end cutter drum sections to cut solid material from a mine face. The end cutter drum sections are moved on the drive shaft from a retracted position to an extended position by rotation of the drive shaft to extend the length of the cutter drum assembly and increase the width of the cut in the mine face.

Additionally, the present invention is directed to a mining machine that includes a mobile frame having a front end portion. A rotor assembly includes a pair of rotor shafts rotatably supported in spaced parallel relation on the frame front end portion. The rotor shafts each include a centerline extending longitudinally on the mobile frame. A cutter drum assembly is positioned forwardly of the frame front end portion and extends transverse thereto below the rotor shafts. The cutter drum assembly includes an intermediate drum section and a pair of end drum sections. A drive shaft rotatably supports the intermediate drum section and end drum sections. The intermediate drum section is separated by gaps from the end drum sections on the drive shaft. A gear case extends forwardly from the frame front end portion into each gap for rotatably supporting the drive shaft on the mobile frame. The gear cases extend longitudinally on the mobile frame below the rotor shafts respectively. The gear cases each include a centerline positioned inboard of and laterally displaced from the rotor shaft centerlines. The end drum sections are positioned on the drive shaft for longitudinal movement toward and away from the gear cases to retract and extend the length of the cutter drum assembly.

Accordingly, a principal object of the present invention is to provide on a boring type mining machine method and apparatus for extending the end portions of a lower cutter drum and utilizing the rotational drive to the cutter drum to extend the drum end portions.

An additional object of the present invention is to provide on a boring machine an extensible cutter drum assembly which minimizes cusps left in the mine floor during the cutting operation.

These and other objects of the present invention will be more completely disclosed and described in the following specification, the accompanying drawings and the appended claims.

DESCRIPTION OF THE PREFERRED EMBODIMENTS

Figure 1:
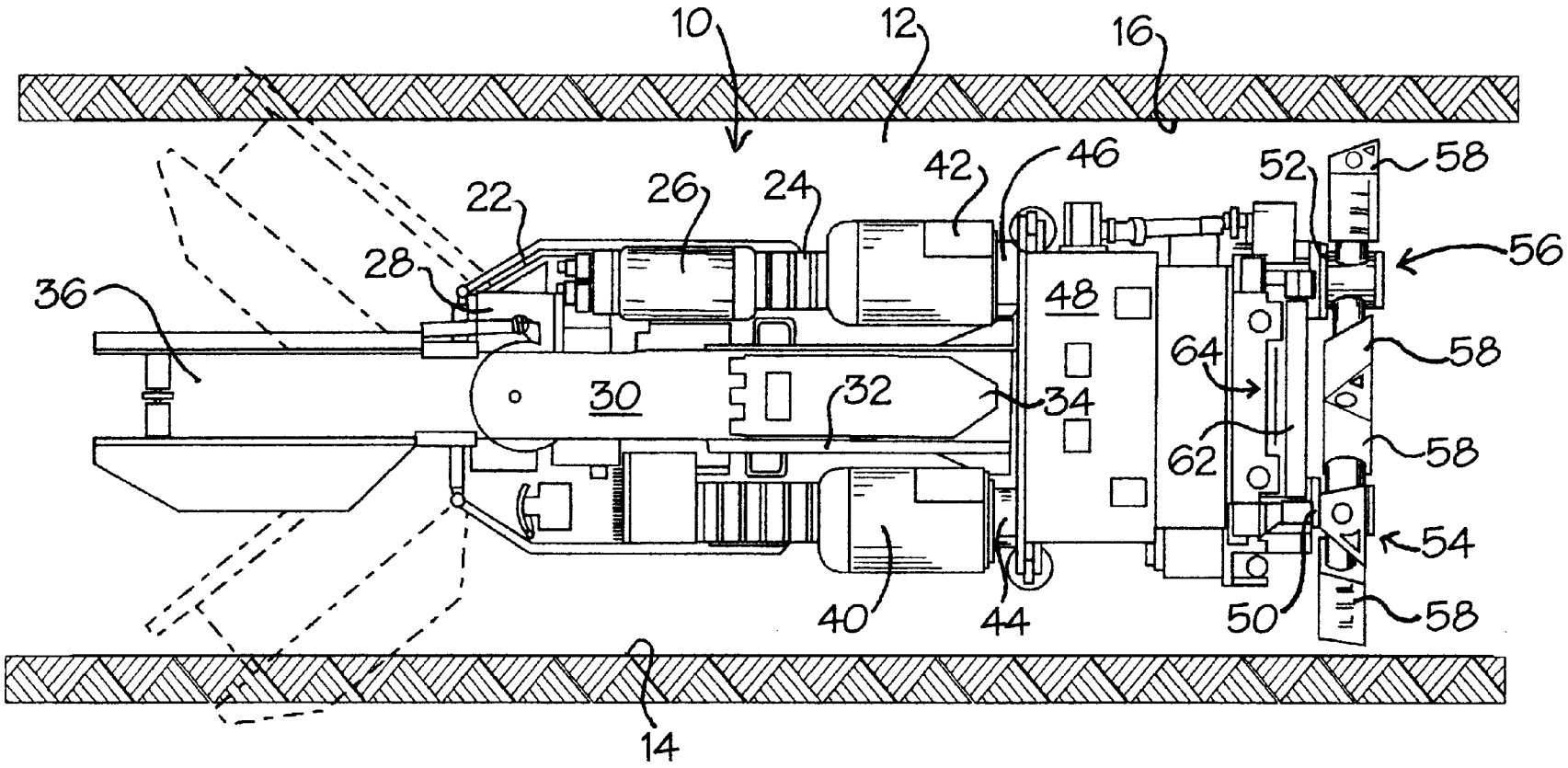
FIG. 1 is a plan view of a boring type continuous mining machine positioned in a mine entry, illustrating a pair of rotor arms for dislodging material from a mine face as the boring machine advances forwardly in the entry.
Figure 2:
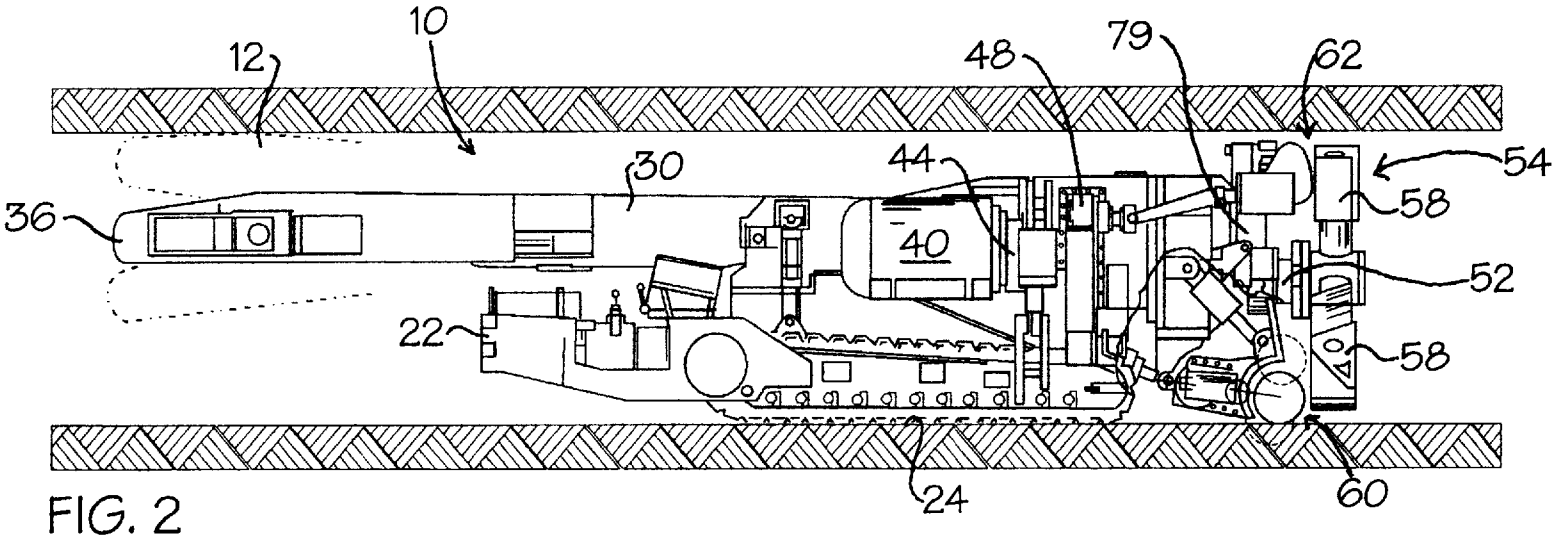
FIG. 2 is a view in side elevation of the boring machine shown in FIG. 1, illustrating one of the rotor arms and upper and lower cutter drum assemblies that dislodge material that is not removed by the rotor arms at the mine roof and floor.
Figure 3:
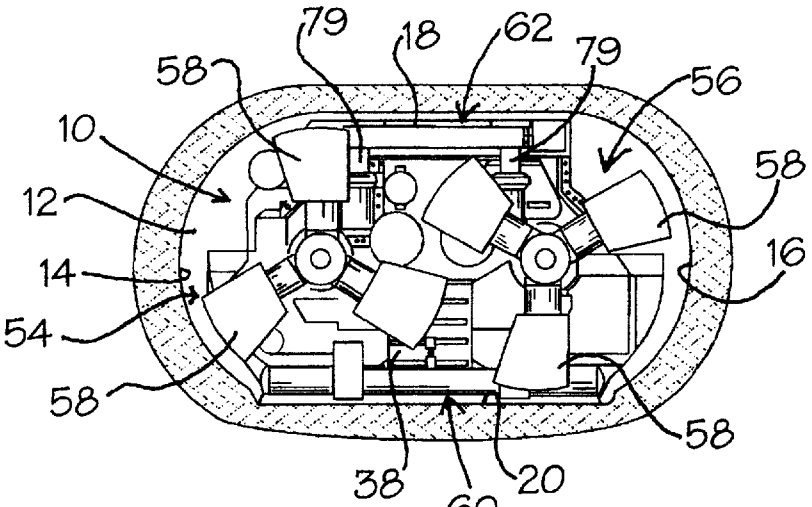
FIG. 3 is a front elevational view of the boring machine shown in FIG. 2, illustrating an oval-shaped entry cut by the combination of a pair of rotor arms and upper and lower cutter drums.

Referring to the drawings and particularly to FIGS. 1–3, there is illustrated a boring type continuous mining machine generally designated by the numeral 10 positioned in a mine entry 12 formed by sidewalls 14 and 16, a mine roof 18, and a mine floor 20 cut by the machine 10. The mining machine 10 advances in the entry 12 to dislodge solid material from a mine face (not shown). Material is dislodged from the mine face, as the mining machine 10 advances in the entry 12 which is formed in the configuration shown in FIG. 3 having curved sidewalls 14 and 16 and a horizontal or level mine roof 18 and mine floor 20. The mine material dislodged from the mine face is gathered onto the mining machine 10 and conveyed rearwardly on the machine where it is transferred to conventional haulage equipment for transport out of the mine.

The mining machine 10 has a body portion or frame 22 suitably mounted on endless crawler tracks 24. Hydraulic motors (not shown) are mounted on the frame 22 for propelling the mining machine 10 during the mining operation. The hydraulic motors are operable through a pump 26 and a controller 28 mounted on the frame portion 22 as shown in FIG. 1. Electric motors can also be used to propel the mining machine 10.

An endless conveyor mechanism 30 is positioned in a trough 32 that extends longitudinally on the machine frame 22 from a front end 34 to an articulated rear discharge section 36. The rear discharge section 36 is laterally pivotal as shown in phantom in FIG. 1. The conveyor front end section 34 includes a pivotally mounted section 38, shown in FIG. 7, that extends forwardly of the front end of frame 22. The pivotal section 38 receives dislodged mine material which is urged by rotor arms and a lower cutter drum assembly onto the conveyor front end section 34. The dislodged material is conveyed rearwardly on the conveyor mechanism 30 to the discharge section 36 where it is transferred, for example, to a conveyor belt or shuttle car for transport out the mine.

As shown in FIG. 1, the mobile machine frame 22 supports a pair of rotor motors 40 and 42 having drive shafts 44 and 46 that extend forwardly through a main gear case 48 to shaft front end portions 50 and 52. The shaft front end portions 50 and 52 are positioned in spaced parallel relation on the front of the mobile frame 22. A pair of rotors or boring heads generally designated by the numerals 54 and 56 are nonrotatably connected to the shaft end portions 50 and 52.

As seen in FIGS. 2 and 3, each rotor 54 and 56 includes a plurality of rotor arms 58. Each rotor arm 58 is telescopic in length, and a plurality of cutter bits (not shown) are mounted on each rotor arm. With this arrangement torque from the rotor motors 40 and 42 is transmitted by the drive shafts 44 and 46 to the rotors 54 and 56 which are rotated in opposite directions. The rotor arms 58 of the rotors 54 and 56 are rotated as the mining machine 10 advances forwardly to dislodge solid material from the mine face.

Figure 4:
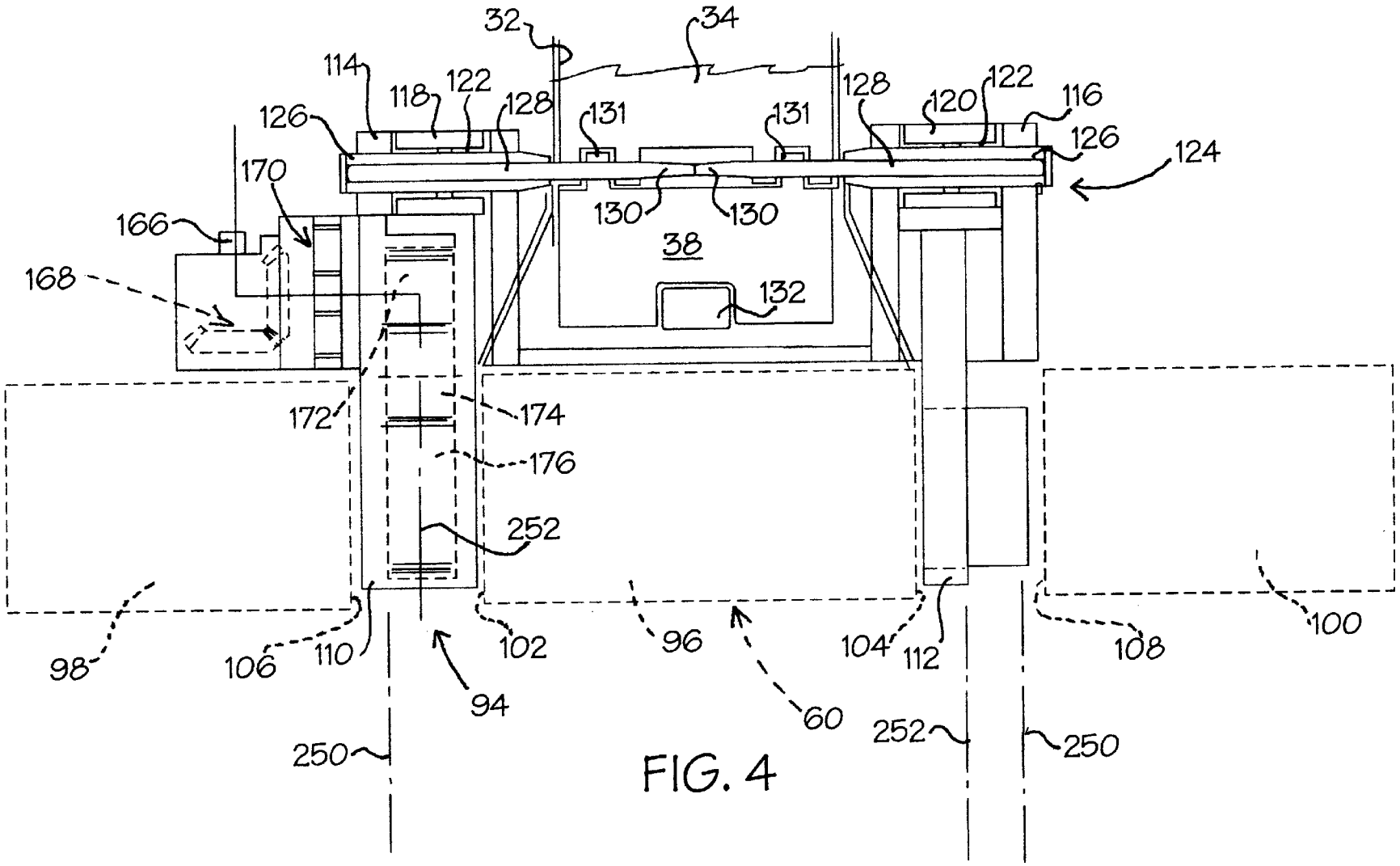
FIG. 4 is a schematic, fragmentary plan view of the lower cutter drum assembly of the boring machine shown in FIGS. 1–3 illustrating, the drum drive and pivotal mounting on the front end of the boring machine.
Figure 5:
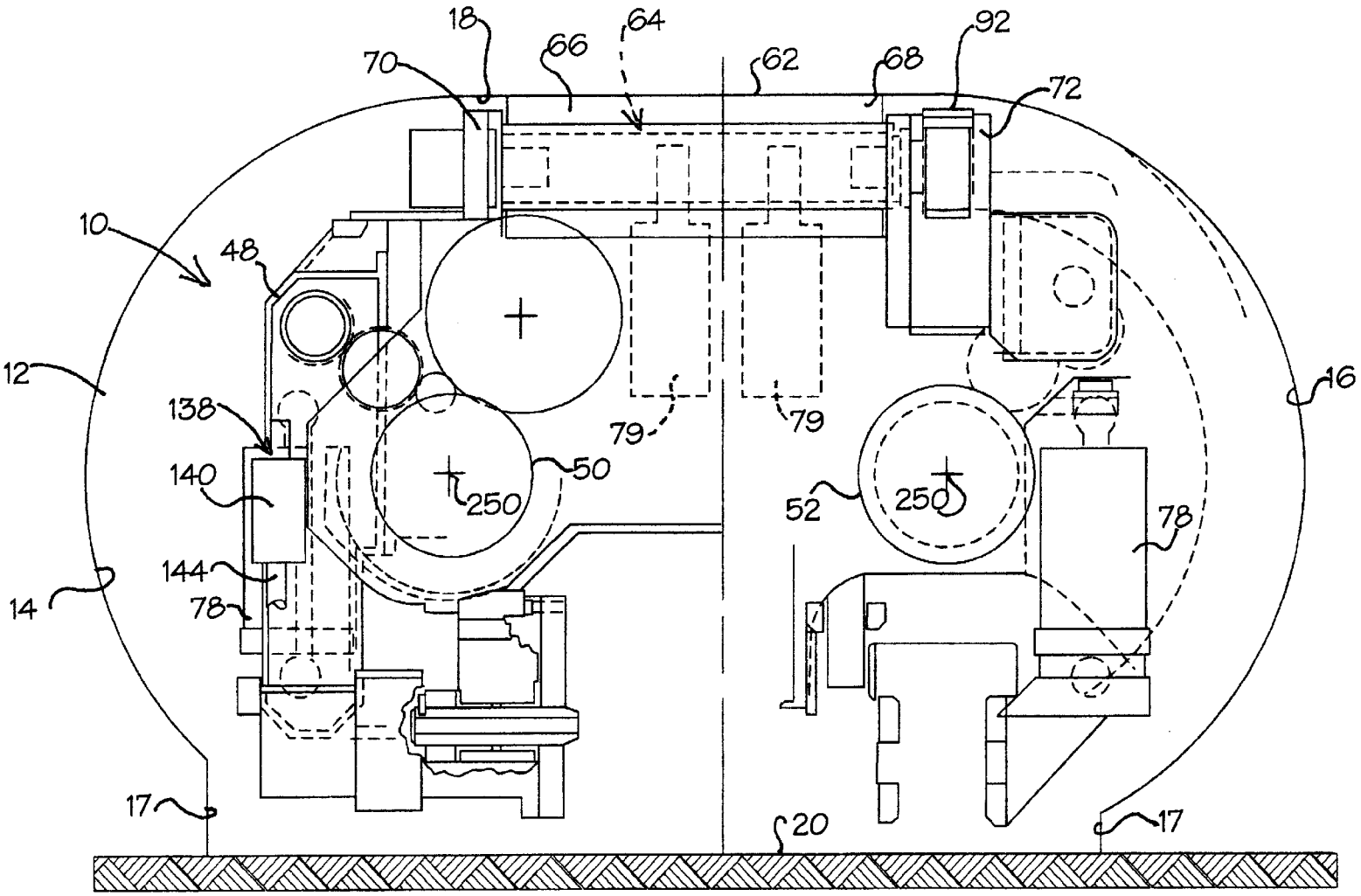
FIG. 5 is a schematic, front elevational view of the boring machine gear case and support frame for the rotor arms and upper and lower cutter drums, illustrating the frame with the rotor arms and cutter drums removed.

The boring action of the rotor arms 58 forms generally semicircular sidewalls 14 and 16 in the mine face on opposite sides of the machine 10, as seen in FIGS. 3 and 5. Also formed by the boring action are cusps (not shown) upstanding from the mine floor 20 and depending from the mine roof 18. These cusps are dislodged by a lower cutting drum assembly and an upper cutting drum assembly, generally designated by the numerals 60 and 62 in FIGS. 2–4 and 7. The cutter drums 60 and 62 are rotatably supported transversely on the front end of the mobile frame 22, rearwardly above and below the rotors 54 and 56.

The cutter drum assemblies 60 and 62 are continuous in length and have a cylindrical configuration with a plurality of cutting elements that extend from the surfaces of the drums. The cutter drums 60 and 62 are operable to remove the cusps that extend from the roof 18 and floor 20 at the areas of the mine face which are beyond the cutting paths of the rotor arms 58.

In accordance with the present invention, the lower cutter drum assembly 60 is extendable in length. The assembly 60 is retracted to permit the mining machine 10 to move into and out of position opposite the mine face. Once in position opposite the mine face, the end portions of the drum assembly 60 are extended to dislodge from the mine floor at the base of the mine face, the material which is not removed by the rotor arms 58. The upper cutter drum assembly 62 is fixed in length and performs a similar function to remove cusps that extend downwardly from the mine roof.

The upper and lower cutter drums 60 and 62 are rotatably supported on the main gear case 48 of the machine frame 22. The cutter drums 60 and 62 are positioned on front end 64 the machine frame 22 transverse to the longitudinal axis of the frame 22. As shown in FIG. 5, the upper cutter drum assembly 62 is a unitary structure rotatably supported at its end portions 66 and 68 by bearing assemblies 70 and 72. The bearing assemblies 70 and 72 are carried on an upper end portion of the gear case 48. In this position, the upper cutter drum 62 dislodges the material from the mine face at the mine roof 18 which is beyond the peripheral cutting paths of the rotor arms 58.

Figure 6:
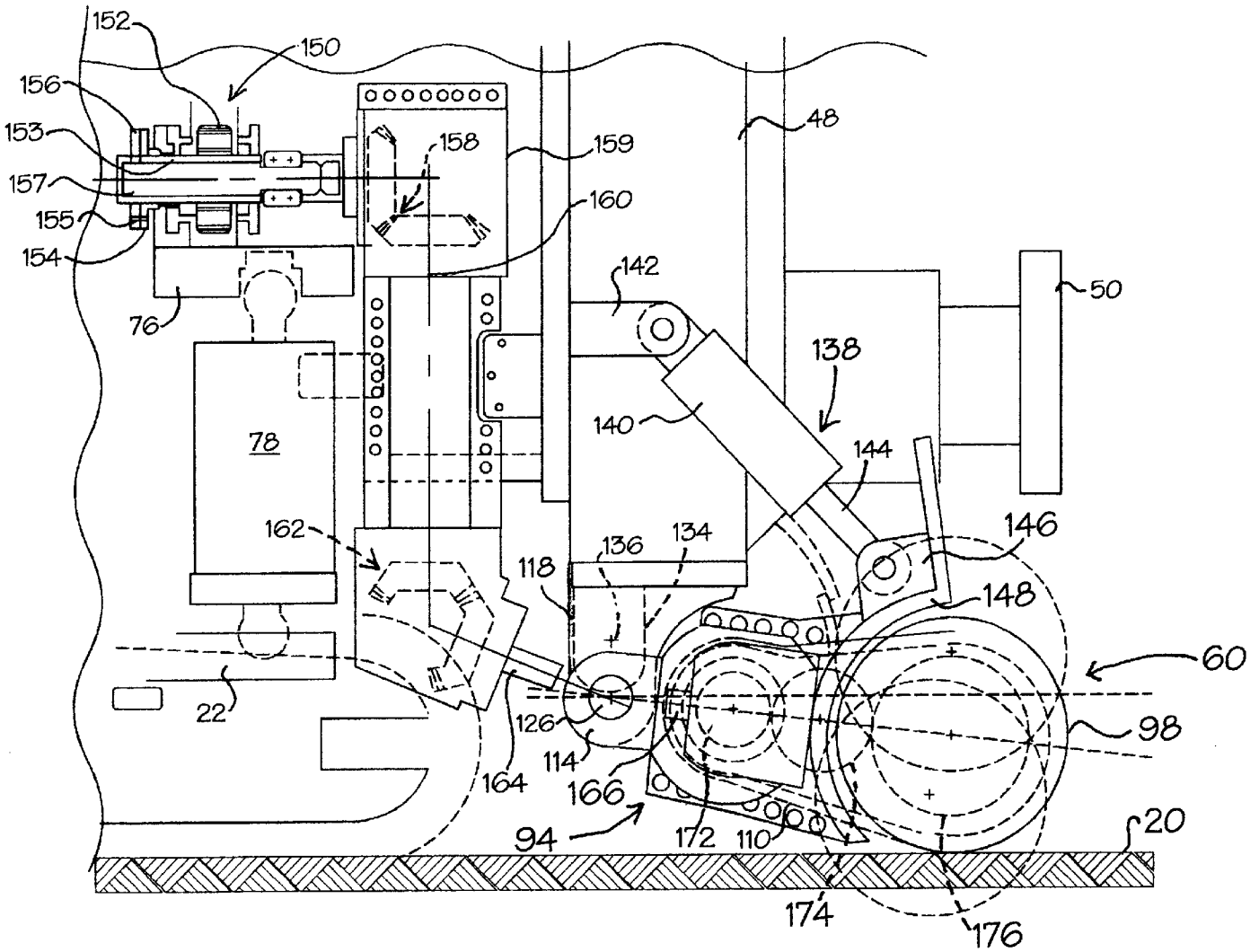
FIG. 6 is a schematic, fragmentary elevational view of the front end of the boring machine, illustrating the pivotal and drive connection of the lower cutter drum on the front end of the machine and the rotor drive shaft with the rotor arm removed for purposes of illustration.
Figure 7:
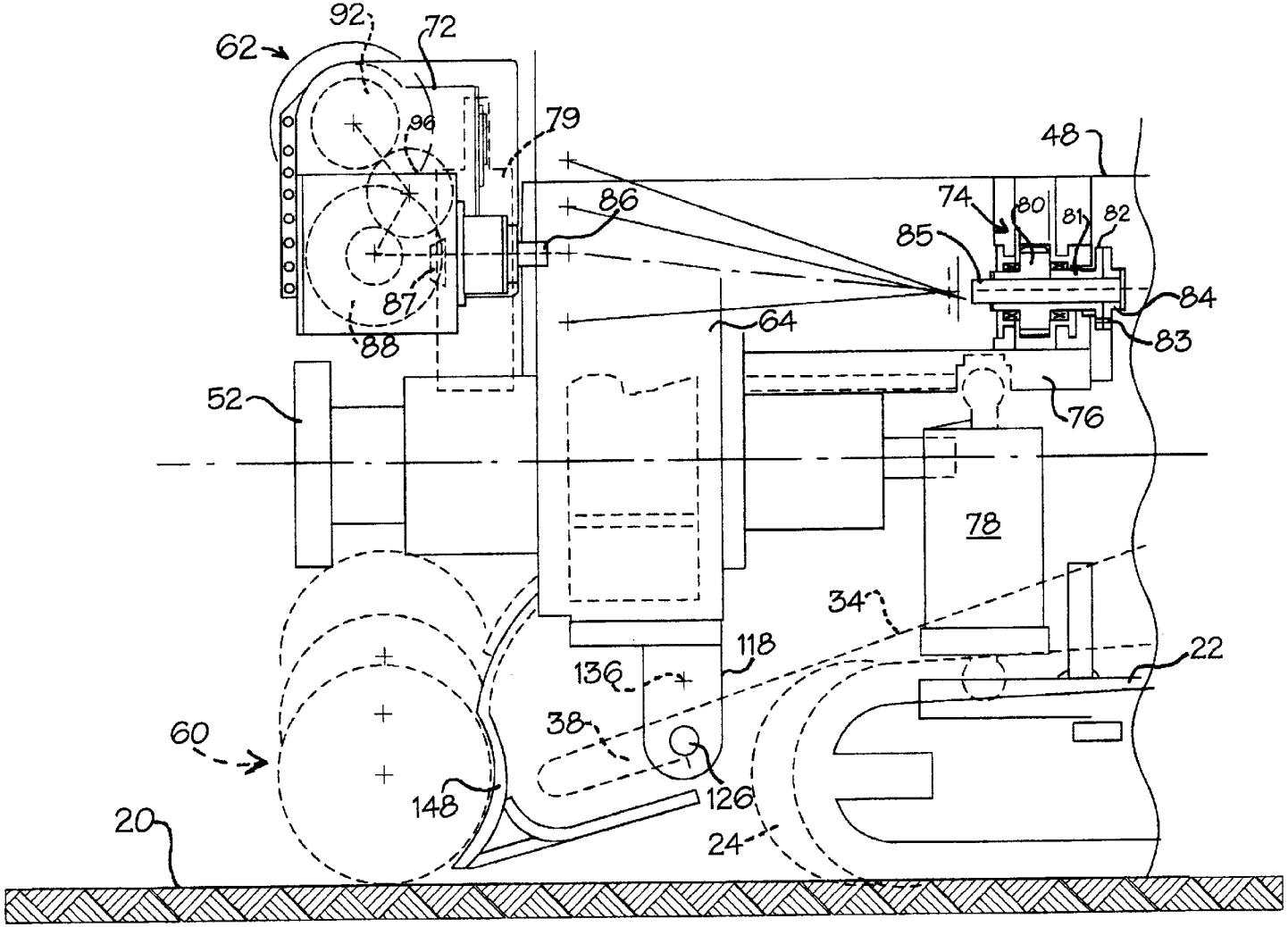
FIG. 7 is a schematic, fragmentary elevational view of the front end of the opposite side of the boring machine shown in FIG. 6, illustrating the upper and lower cutter drums and a rotor arm drive shaft.

Rotation is transmitted to the upper cutter drum 62 from the main gear case 48 through reduction gearing generally designated by the numeral 74 in FIG. 7. The reduction gearing 74 is a component of the gear case 48. A frame 76 on gear case 48 is connected to the upper end of a pair of trim cylinders 78 shown in FIGS. 5–7. The cylinders 78 are spherically connected at their lower ends to the machine frame 22. Extension and retraction of the cylinders 78 vertically moves the front end of the gear case 48 with respect to the machine frame 22 to dislodge material as the machine 10 trams up hill or down hill.

The upper cutter drum 62 and support frame 64 are supported for vertical movement on the front end of the machine frame 22 by operation of a pair of piston cylinder assemblies 79, schematically illustrated in FIGS. 2, 3, 5 and 7. The cylinder portions of assemblies 79 are mounted on the front face of main gear case 48. The extensible rod portions are connected to the support frame 64. With this arrangement, the upper cutter drum 62 is raised and lowered relative to the main gear case 48 upon actuation of the assemblies 79.

The position of the cutter drum 62 is determined by the diameter of the bore cut by the rotors 54 and 56. In one embodiment of the mining machine 10, the rotor arms 58 of the rotors 54 and 56 are extended in length to cut bores of a diameter in the range of eight to ten feet.

As shown in FIG. 7, the reduction gearing 74 for transmitting drive to the upper cutter drum 62 includes a driven gear 80 splined to shaft 81 which is splined to a shear pin flange 82. Flange 82 is nonrotatably connected through a shear pin 83 to a driven flange 84. Flange 84 is nonrotatably connected to a shaft 85 that is rotatably journaled on gear case 48. Rotation of the gear 80 and shaft 85 is transmitted by a universal shaft (not shown) that is connected at its end portions to the shaft 85 and a shaft 86.

The shaft 86 is drivingly connected to a bevel gear 87 that meshes with a gear 88 which in turn transmits rotation through gears 90 and 92 to the upper cutter drum 62. With this arrangement, the upper cutter drum 62 is transversely positioned at a preselected elevation on the machine frame 22. Rotation of cutter drum 62 trims or dislodges from the mine roof 18 at the face solid material that is not dislodged by the rotor arms 58.

The lower cutter bar 60 serves a similar purpose in removing from the mine floor 20 at the face the solid material that is not dislodged by the rotor arms 58. As seen in FIGS. 4 and 6, the lower cutter drum assembly 60 is rotatably supported by a gear case generally designated by the numeral 94 that is pivotally mounted to the bottom of the main gear case 48. The lower cutter drum 60 includes an intermediate drum section 96 and a pair of extensible end drum sections 98 and 100. The intermediate drum section 96, as shown in FIG. 4, has outer annular edge portions 102 and 104, and the end drum sections 98 and 100 have inner annular edge portions 106 and 108, respectively. The drum sections 96, 98, and 100 include a plurality of cutting elements, shown in FIGS. 8 and 9, that extend peripherally from the drum sections.

As shown in FIG. 6, the lower cutter drum assembly 60 is supported by the gear case 94 for pivotal movement into and out of contact with the mine floor 20. The gear case 94 is pivotally connected to the lower end portion of the front end of the main gear case 48. The gear case 94 extends forwardly of the gear case 48 into the gaps between the drum intermediate section 96 and the end drum sections 98 and 100. The pivoted position of the lower cutter drum 60 in and out of contact with the mine floor is determined by the diameter bore cut by the rotors 54 and 56.

As seen in FIG. 4, the gear case 94 that rotatably supports the lower cutter drum assembly 60 includes spaced apart housing portions 110 and 112 that extend forwardly into the gaps that separate the intermediate drum section 96 from the end drum sections 98 and 100. The housings 110 and 112 extend rearwardly from the drum sections to clevis-type mountings 114 and 116 that are pivotally connected to the main gear case 48.

The mountings 114 and 116 are connected to brackets 118 and 120 that extend from the lower end portion of the gear case 48. Bushings 122 are retained in the brackets 118 and 120 and receive a pin assembly generally designated by the numeral 124. The pin assembly 124 connects the clevis-type mountings 114 and 116 to the brackets 118 and 120.

The pin assembly 124 includes a first pair of short pins 126 that are positioned in the bushings 122. The pins 126 have a through bore to receive long pins 128 having tapered end portions 130. The pins 128 extend through the gear case 48. With this arrangement, the gear case 94 including the housing portions 110 and 112 that support the lower cutter drum assembly 60 are mounted for pivotal movement about the pin assembly 124 on the machine main gear case 48.

The conveyor section 38 is also pivotally connected to the elongated pins 128, as shown in FIGS. 4 and 7. As seen in FIG. 4, the conveyor section 38 includes a pair of rearwardly extending brackets 131. The brackets 131 include through bores aligned with the bushings 122 to receive the pins 128. An idler roller 132 on the front end of the conveyor section 38 rotatably supports one end of a conveyor chain that runs through the conveyor trough 32. The conveyor chain is not shown in FIG. 4.

Preferably, the cutter drum gear case 94 is pivotally connected to the brackets 118 and 120 on the main gear case 48 as shown in FIGS. 4 and 6 for positioning the lower cutter drum assembly 60 for operation of the rotor arms 58 extended to cut bores of nine feet and ten feet in diameter. A common pivot point of the gear case 94 on the main gear case 48 is used for both the nine and ten foot cutting diameters of the rotor arms 58.

The rotor arms 58 are also operable to cut an eight foot diameter. To accommodate the eight foot diameter, the gear case 94 is moved from the brackets 118 and 120. Then the brackets 118 and 120 are removed from the gear case 48 and replaced with a second set of brackets 134. The brackets 134 form a pivot point above the pivot point formed by the brackets 118 and 120. One of the brackets 134 is shown in phantom in FIG. 6. The brackets 134 are bolted to the bottom of the machine main gear case 48. Each bracket 134 includes a pivot point 136 (shown in FIG. 6) for receiving the pin assembly 124 that supports the gear case 94 for pivotal movement on the gear case 48.

Pivotal movement of the gear case 94 pivots the lower cutter drum assembly 60 relative to the main gear case 48. The pivotal movement is accomplished by the provision of a pair of cylinder assemblies generally designated by the numeral 138. Only one assembly 138 is shown in FIGS. 5 and 6, but it should be understood that an assembly 138 is positioned on each side of the machine frame 22.

Each piston cylinder assembly 138 includes a cylinder portion 140 pivotally connected at its base to a bracket 142 extending from the main gear case 48. An extensible rod 144 extends from the cylinder portion 140 and is connected at its outer end portion to a bracket 146 mounted on a pusher plate 148 that is positioned at the front end portion of the gear case 94. The pusher plate 148 extends at its lower end portion in surrounding relation to the lower cutter drum assembly 60, as shown in FIG. 6. With this arrangement, extension and retraction of the rods 144 relative to the cylinder portions 140 pivots the gear case 94 about the main gear case 48 to raise and lower the lower cutter drum assembly 60 into and out of engagement with the mine floor 20. The relative pivoted positions of the drum assembly 60 for the cutting diameters eight, nine, and ten feet are shown in phantom in FIG. 6.

Referring to FIGS. 4–6, there is illustrated the drive connection to the lower cutter drum assembly 60 from the rotor motor 40. As shown in FIG. 6, a reduction gear assembly generally designated by the numeral 150 is mounted on the gear case 48 of machine frame portion 22. The gear reduction assembly 150 is drivingly connected in a conventional manner to the drive shaft 44 of the rotor motor 40 shown in FIG. 1.

The reduction gear assembly 150 includes a driven gear 152 splined to a shaft 153 which, in turn, is splined to shear pin flange 154. Flange 154 is nonrotatably connected through shear pin 155 to a driven flange 156. Flange 156 is nonrotatably connected to a shaft 157.

The shaft 157 is rotatable supported in the gear case 48 and drivingly connected to a bevel gear set 158 that is rotatably supported within a vertical transfer gear case 159 mounted on the machine frame main gear case 48. This arrangement is similar to the reduction gearing 74 described above for transmitting drive to the upper cutter drum 62.

From the shaft 157, rotation is transmitted through the bevel gear set 158 to a vertical shaft (not shown) rotatably supported within the transfer gear case 159. The centerline of the vertical shaft is designated by the numeral 160 in FIG. 6. Connected to the lower end of the vertical shaft in the gear case 159 is a second bevel gear set generally designated by the numeral 162. Extending from the bevel gear set 162 is a drive shaft 164 that is connected by a universal joint (not shown) to a drive shaft 166 of a bevel gear set generally designated by the numeral 168 in FIG. 4.

The bevel gear set 168 is supported by the gear case 94 and is drivingly connected through a planetary gear assembly generally designated by the numeral 170 to the drum assembly 60. Rotation from the planetary gear assembly 170 is transmitted to a pinion gear 172. From the pinion gear 172, rotation is transmitted through a reach gear 174 to a drum drive gear 176 that is rotatably supported within the gear case 94 to transmit rotation to the lower cutter drum assembly 60.

Figure 8:
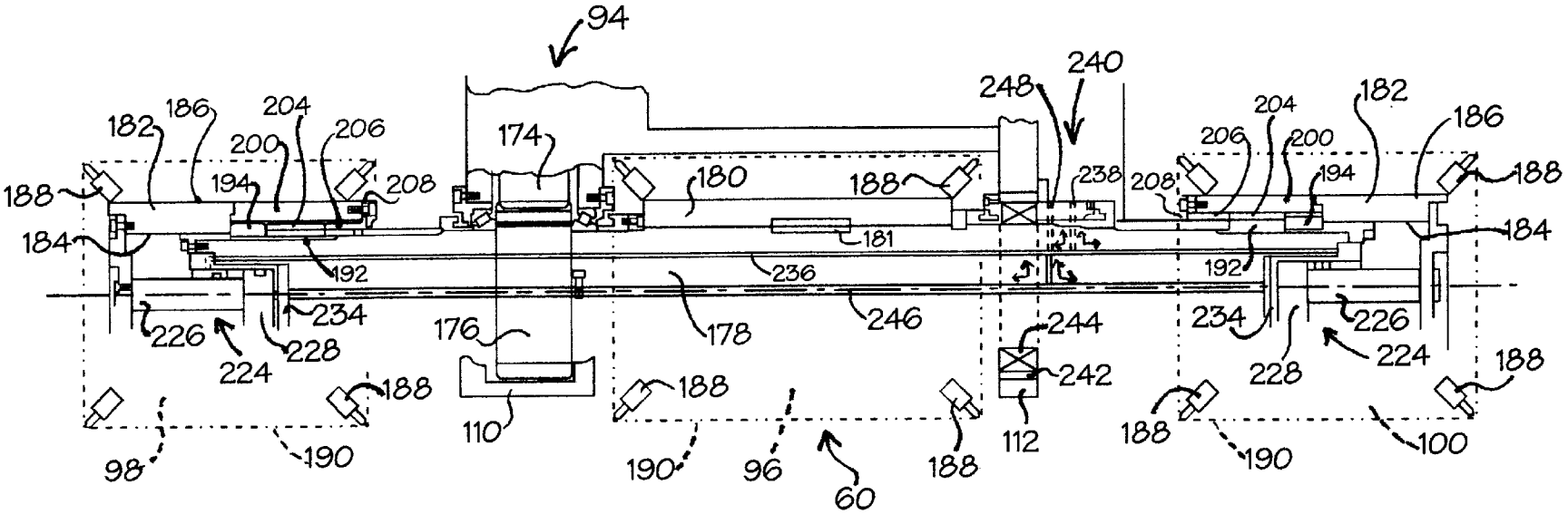
FIG. 8 is a schematic, fragmentary plan view of the lower cutter drum, illustrating a pair of end drum sections mounted on a drum drive shaft for extension of the cutter drum.
Figure 9:
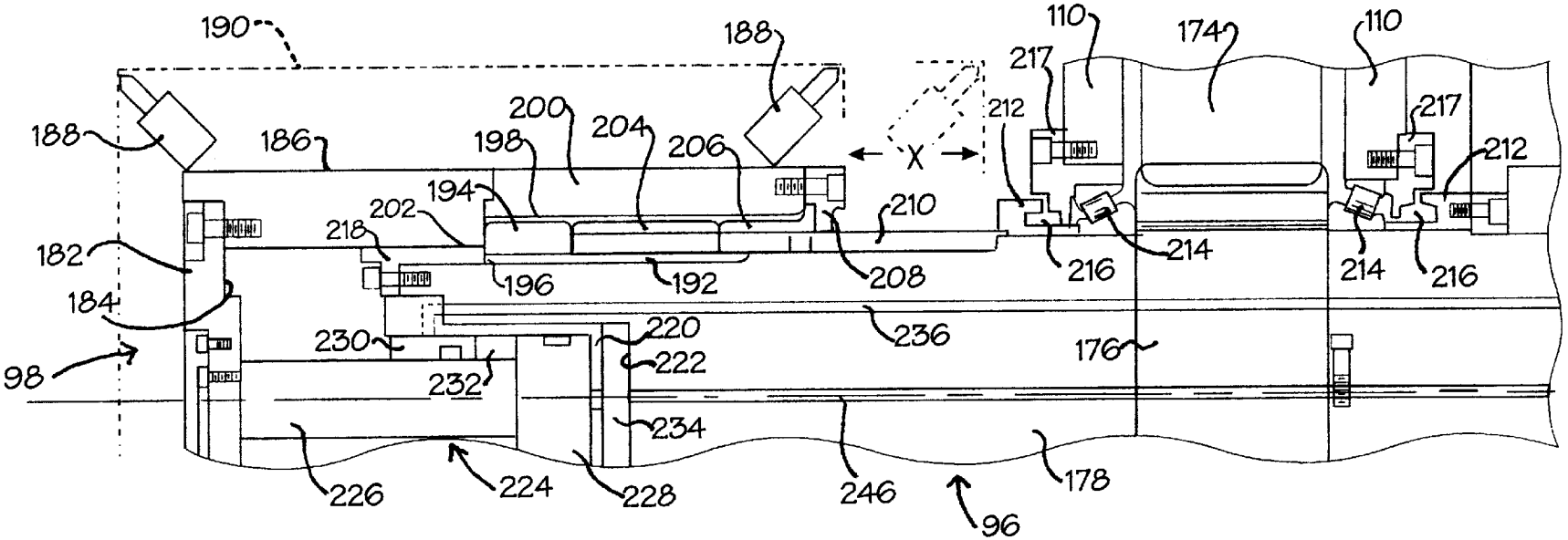
FIG. 9 is a schematic, fragmentary plan view similar to FIG. 8, illustrating the mechanism for extending and retracting one of the end drum sections on the drum drive shaft.

Now referring to FIGS. 8 and 9, there is illustrated in greater detail the drive connection from the drum drive gear 176 to the cutter drum assembly 60. The intermediate drum section 96 and end drum sections 98 and 100 of the lower cutter drum assembly 60 are connected to a drive shaft 178. As discussed above, the gears 172–176 are rotatably supported in the housing 110 of gear case 94. The gear case housing 110 is positioned in the gap between the intermediate drum section 96 and the end drum section 98 around the drive shaft 178. The drive shaft 178 extends through each of the drum sections 96–100.

The intermediate drum section 96 includes a cylindrical body portion formed by a pair of drum housing sections 180, one of which is shown in FIG. 8. Each section 180 is connected by a key 181 or a straight splined connection to the drive shaft 178. The housing sections 180 are bolted in a conventional manner to one another in surrounding relation with the drive shaft 178.

The intermediate drum section 96 is separated from the end drum section 98 by the gear case housing 110. Similarly, the end drum section 100 is separated from the intermediate drum section 96 by the gear case housing 112, shown in FIG. 8. The gear case housing 112 is positioned in the gap between the intermediate drum section 96 and end drum section 100.

Each of the end drum sections 98 and 100 has a similar cup-shaped configuration formed by an annular body portion 182 having an inner annular wall 184 and an outer annular wall 186. A plurality of cutting elements 188 are secured to and extend outwardly from the peripheral surface of the housing 180 of the intermediate drum section 96 and the outer annular walls 186 of the end drum sections 98 and 100. The bit pattern formed by the cutting elements 188 is indicated by the -.- lines 190 in FIGS. 8 and 9.

The lower cutter drum assembly 60 is operable to dislodge from the mine floor 20 adjacent to the mine face the solid material left uncut by the rotors 54 and 56. As the cutter drum assembly 60 completes a shear cut at the mine floor 20 adjacent to the mine face, a horizonal surface is formed on the mine floor 20 and vertical portions 17 of the sidewalls 14 and 16 extend upwardly from the mine floor 20 as shown in FIG. 5.

In accordance with the present invention, the bolted drum housing sections 180 forming the intermediate drum section 96 are keyed or splined to the drum drive shaft 178. The bolted housing sections 180 are longitudinally fixed on the intermediate section of the draft shaft 178 to rotate with the shaft 178. The entire end drum sections 98 and 100 are connected to the opposite ends of the drive shaft 178 to rotate with the drive shaft 178 and to move longitudinally on the shaft 178. The end drum sections 98 and 100 are movable on the drive shaft 178 between a fully extended position as illustrated in FIG. 8 to a retracted position as illustrated in FIG. 4. In the fully extended position of the end drum sections 98 and 100, the lower cutter drum assembly 60 forms the cut pattern at the mine floor 20 and the sidewall portions 17 as shown in FIG. 5.

The drive connection of the end drum sections 98 and 100 to the drive shaft 178 is shown in FIG. 8. The extensible mounting of the end drum section 98 on the shaft 178 is shown in detail in FIG. 9. The same connection applies for the end drum section 100 on the opposite end of the drive shaft 178.

Each end drum section 98 and 100 is drivingly connected to the end portions of the drive shaft 178 through meshing helical splines. Internal helical splines (not shown) of the end drum sections 98 and 100 mesh with external helical splines 192 on the drive shaft 178. The helical splines 192 on the drive shaft 178 extend through opposite helical angles on the end portions of the drive shaft 178. The drive shaft splines 192 engaging the splines of end drum section 98 follow a helical angle that actuates rotational longitudinal movement of the end drum section 98 away from the intermediate drum section 96 upon rotation of the drive shaft 178. Similarly, the drive shaft splines 192 engaging the splines of end drum section 100 follow a helical angle in the opposite direction. This permits the end drum section 100 to move longitudinally away from the intermediate drum section 96 as it rotates upon rotation of the drive shaft 178.

With the above described arrangement, rotation of the drive shaft 178 generates thrust which is transmitted through the helical splines 192 to the end drum sections 98 and 100 to advance the end drum sections longitudinally outwardly on the drive shaft 178 to extend the length of the cutter drum assembly 60. Thus, rotation of the drive shaft 178 actuates outward movement of the drum end sections 98 and 100 on the drive shaft 178 to extend the width of the lower cutter drum 60. This is accomplished by the helical splined connection of the drum end portions 98 and 100 to the shaft 178. The angle of the helices on the end portions of the drive shaft 178 extends in opposite directions so that upon rotation of the shaft 178 the drum end sections 98 and 100 move outwardly away from one another to an extended position on the shaft 178.

As shown in detail in FIG. 9, the helical splines 192 on the shaft 178 are connected through a sleeve 194 that surrounds the end of the shaft 178 within the end drum section 98. The sleeve 194 has an internally splined surface 196 that meshes with the external helical splines 192 on the shaft 178. An externally splined surface 198 of the sleeve 194 is nonrotatably connected to an annular portion 200 of the end drum body portion 182. With this arrangement, rotation is transmitted from the shaft 178 through the sleeve 194 to the annular body portion 182 of the end drum section 98.

The sleeve 194 that transmits rotation from the drive shaft 178 to the end drum section 98 is retained in a fixed position within the drum body portion 82 by abutment at one end with a shoulder 202 on the outer annular wall 186 and at an opposite end with a tubular spacer 204 aligned with a bushing 206. The bushing 206 is clamped to the end of the annular body portion 182 by a collar 208 bolted to the end drum body portion 182. The tubular spacer 204, bushing 206, and collar 208 are longitudinally positioned on a annular sleeve 210 press fit on the drive shaft 178.

The sleeve 210, as shown in FIG. 9, extends from the end of the helical splines 192 at one end to a seal carrier generally designated by the numeral 212 at an opposite end. The seal carrier 212 is also press fit on the shaft 178 and retains bearings 214 within the gear case housing 110 for rotatably supporting the gear 176 and the drive shaft 178 relative to the fixed gear case 94. The bearings 214 are surrounded by seals 216 which are retained on the gear case housing 110 by the seal carrier 212 and seal retainers 217 that are bolted to the housing 110.

By connecting the end drum section 98 to the drive shaft 178 through the helical splines 192 as shown in FIG. 9, the drum end portion 98 is movable longitudinally on the annular sleeve 210 of the shaft 178. The entire drum end portion 98 is movable or extensible the distance X, as shown in the extended position is FIG. 9. In the retracted position of the drum end portion 98 on the shaft 178, the collar 208 is positioned closely adjacent to the seal carrier 212.

Upon rotation of the shaft 178, the thrust from the shaft 178 is transmitted through the helical splines 192 to the annular body portion 182 of the end drum section 98. Because of the helically splined connection, the end drum body portion 182 rotates as it advances longitudinally outwardly on the shaft 178. The end drum body portion 182 advances until the splined sleeve 194 abuts bushing 218 that is bolted to the end of the shaft 178. The abutting contact of the sleeve 194 with the bushing 218 is shown in FIG. 9.

The movement of the end drum sections 98 and 100 on the drive shaft 178 is controlled by a hydraulic cylinder extending between the drive shaft 178 and each end drum section 98 and 100. This arrangement for the end drum section 98 is shown in detail in FIG. 9 and is the same for the end drum section 100, as shown in FIG. 8. The bushing 218 retains a cup-shaped member 220 within a recessed end 222 of the shaft 178. The cup 220 surrounds a piston cylinder assembly generally designated by the numeral 224 that is bolted to the body portion 182 of the end drum section 98.

The piston cylinder assembly 224 includes a cylinder rod 226 and a piston 228. The piston rod 226 is bolted to body portion 182 of the end drum section 98. A packing gland 230 (shown in FIG. 9) is retained by the cup-shaped member 220 in sealing relation with the cylinder rod 226. Fluid cavities 232 and 234 are provided on opposite sides of the piston 228. The piston 228 moves longitudinally outwardly within the cup-shaped member 220 to the fully extended position of the end drum section 98 when the piston 228 abuts the packing gland 230.

The end drum section 98 is shown in the fully extended position in FIG. 9, but for purposes of illustration the piston 228 is shown displaced from the gland 230 in the fluid cavity 232. In normal operation in the fully extended position, the piston 228 abuts the gland 230 to stop the outward movement of the end drum section 98 on the shaft 178.

Fluid under pressure is supplied to opposite surfaces of the piston 228 within the cup-shaped member 220 that is rigidly secured to the end of the shaft 178. Fluid is supplied to the cavity 232 on one side of the piston 228 through a bore 236 that extends the full length of the shaft 178. The bore 236 is positioned offset from the longitudinal centerline of the shaft 178. The bore 236 is connected to an inlet 238 of a rotary union assembly generally designated by the numeral 240 in FIG. 8.

The rotary union 240 includes a sealed connection for a hydraulic line (not shown) to the inlet 238 of the rotating drum assembly 60. One component of the rotary union includes a static seal that is connected to the fixed housing portion 112 of the gear case 94. As schematically illustrated in FIG. 8, the housing portion 112 includes an annular sleeve 242 for retaining a bearing 244 to rotatably support the shaft 178 within the fixed housing portion 112. Thus, this static portion of the rotary union 240 is secured to the housing portion 112.

A dynamic seal portion of the rotary union 240 is mounted on the shaft 178. This permits fluid to pass in a sealed manner from the static portion of the union 240 through the inlet 238 into the dynamic portion of the union and therefrom into the bore 236. The pressurized fluid supplied to the bore 236 acts upon the side of the piston 228 for retracting the respective drum end portions 98 and 100 on the shaft 178.

To supply pressurized fluid through the rotary union 240 for extending each end drum section, a bore 246 extends through the shaft 178 on the centerline of the shaft 178, as shown in FIGS. 8 and 9. Pressurized fluid is introduced into the bore 246 through an inlet 248 in the rotary union assembly 240. The pressurized fluid is supplied from axial bore 246 through the cup-shaped member 220 into the cavity 234 to act upon the extreme end of the piston 228.

As seen in FIG. 8, to extend both end drum sections 98 and 100 on the shaft 178 fluid is introduced through the inlet 248 and the bore 240 to both drum end portions 98 and 100. Then to retract or stop the outer movement or extension of the end drum sections 98 and 100, fluid to the inlet 248 is interrupted and fluid is supplied through the inlet 238 to bore 236. In this manner, the outward movement of the end drum sections 98 and 100 is controlled between the fully retracted and extended positions on the drive shaft 178.

In accordance with the present invention, extension of the end drum sections 98 and 100 is not limited to application of the pressurized fluid directed through the bore 246 to the end of the piston head 228. The provision of the helical splined connection of the end drum sections 98 and 100 to the drive shaft 178 applies thrust to the end drum sections to rotatably advance them longitudinally on the shaft 178. Thus, rotation of the shaft 178 actuates extension of the end drum sections. Therefore, the fluid pressure introduced through the rotary union 240 to extend the end drum sections is substantially less than the pressure that would be required if the piston cylinder assemblies 224 were the sole mechanism for advancing the end drum sections 98 and 100 on the drive shaft 178.

Under normal operating conditions, the seals within the rotary union 240 would be continually exposed to high operating pressures, causing accelerated wear of the seals. This would be the case particularly when the shaft 178 is rotating at high speeds for dislodging operations. With the helically splined connection of the end drum sections 98 and 100 to the drive shaft 178, piston cylinder assemblies 224 operate at substantially reduced fluid pressures. This in turn permits the rotary union 240 to operate at substantially reduced pressure. Consequently the operating life of the union seals is extended, and the occurrence of leakage due to seal failure is substantially minimized, if not eliminated.

In certain cutting operations, it may not be desired to extend the lower cutter drum assembly 60 to its fully extended length and instead limit the drum extension. In this embodiment, axial movement of the drum end portions 98 and 100 is restrained when the drum end portions are advanced to a certain point along the length of the shaft 178. While the shaft 178 continues to rotate, the end drum sections 98 and 100 are restrained from further movement, even though they are not in a fully extended position on the shaft 178.

In another embodiment of the present invention, the end drum sections 98 and 100 are extended and retracted without the need to supply pressurized fluid internally within the shaft 178 through a rotary union. The rotary union 240 and the high pressure seals required therefor are eliminated. The piston cylinder assemblies 224 operate as conventional shock absorbers with a captured volume of fluid that acts as a cushion to normally retain the end drum sections 98 and 100 in a retracted position on the shaft 178.

Upon rotation of the shaft 178, the thrust applied through the helical splines overcomes the opposing fluid pressure to advance the end drums 98 and 100 outwardly. When the shaft 178 stops rotating, the fluid pressure restrains further outward movement of the end drums. Any force applied inwardly on the end drum sections 93 and 100, such as contact with the mine sidewalls, urges them to move inwardly on the stationary shaft 178. In this manner, the end drum sections 98 and 100 are retracted on the shaft 178. In this manner, the end drum sections 98 and 100 are retracted on the shaft 178.

Now referring to FIG. 5, there is illustrated the main gear case 48 at the front end of the machine frame 22 with the rotors arms 58 removed from the front end portions 50 and 52 of the rotor drive shafts 44 and 46. The centerline of each rotor drive shaft 44 and 46 is designated by the numeral 250. For purposes of illustration, the centerline 250 is superimposed on the plan view of the lower cutter drum assembly 60 shown in FIG. 4.

In FIG. 4 a centerline is designated by the numeral 252 for the housing portion 110 of the gear case 94. With conventional boring type mining machines, the centerlines 250 and 252 are vertically aligned as shown diagrammatically for the rotor 54, shown in FIG. 10. In other words, the centerline of the drum gear case is aligned with the centerline of the respective rotor drive shaft. But in accordance with the present invention, as shown in FIG. 4, the centerlines 252 of gear case housing portions 110 and 112 are positioned inboard of or offset from the centerlines 250. Thus, the centerlines 250 and 252 are laterally spaced apart and not in vertical alignment.

With the prior art devices the centerlines 250 and 252 are vertically aligned. This is shown schematically in FIG. 10. Consequently, upon outward extension of the drum end portions 98 and 100, a gap is formed between the peripheral cutting path of the end drum sections 98 and 100 and the rotors 54 and 56 to leave uncut portions or cusps projecting upwardly from the mine floor. While the length of the lower cutter drum assembly 60 is extended to increase the width of the cut, a level mine floor 20 is not formed because cusps remain at the mine floor adjacent to the mine face. This disadvantage is overcome by the present invention.

Figure 10:
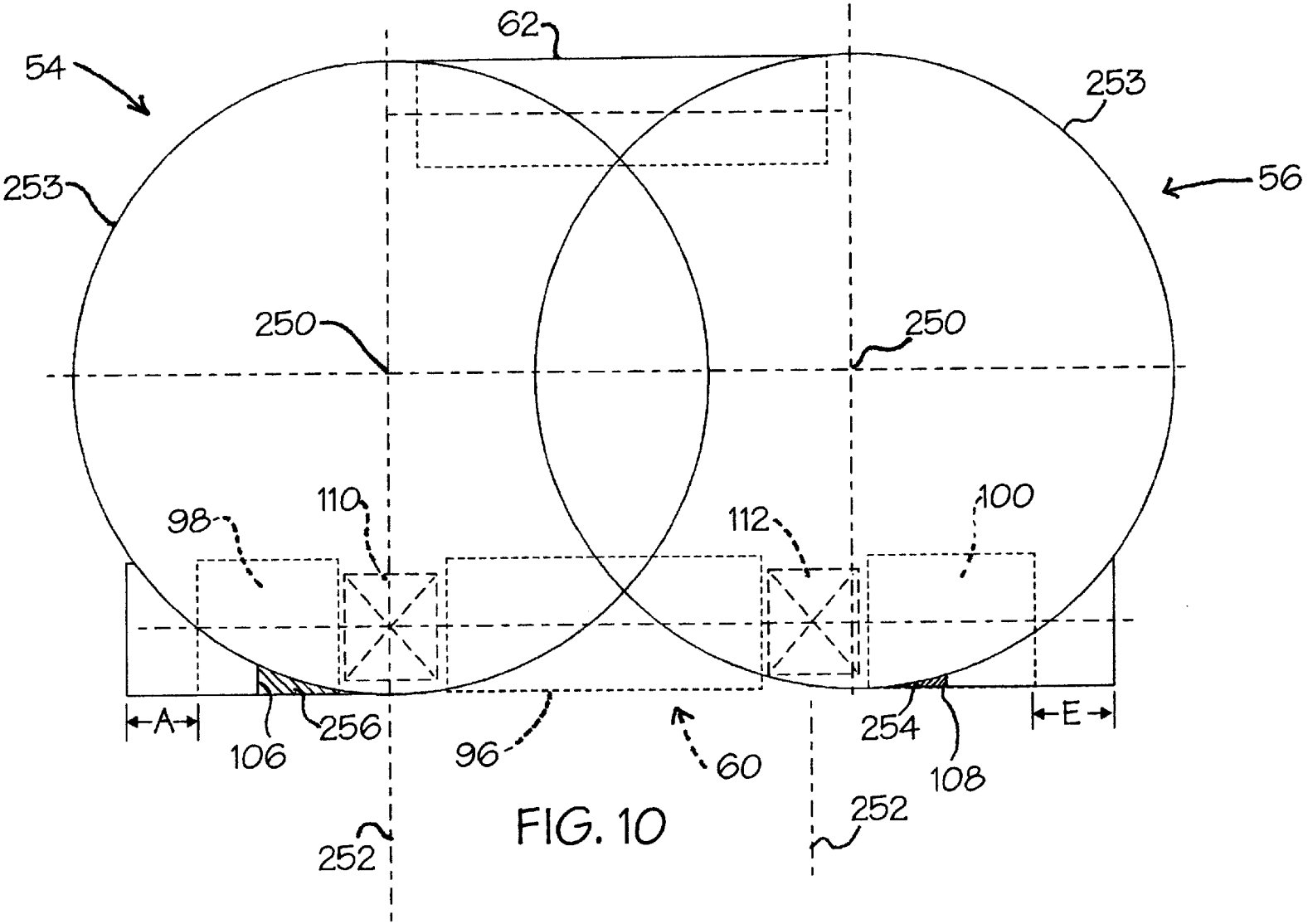
FIG. 10 is a diagrammatic representation of the front end of a boring machine, illustrating for comparison a prior art embodiment with the present invention for mounting the cutter drum end sections on the front end of the machine.

Referring to FIG. 10, there is diagrammatically illustrated a comparison between the prior art arrangement of aligning the gear case with the rotating axis of the rotor and the present invention of displacing the centerlines of the gear case and the rotor, as described above. For purposes of comparative illustration, the prior art arrangement and the present invention are both illustrated in FIG. 10. The cutting path for the rotors 54 and 56 is illustrated by the circles 253. The centerline for the rotor drive shafts is identified by the numerals 250. The upper cutter bar assembly 62 is schematically illustrated as is the lower cutter drum assembly 60 having the intermediate drum section 96 and the end drum sections 98 and 100.

For the rotor 54, the prior art arrangement is illustrated in which the gear case housing portion 110 is positioned with its centerline 252 vertically aligned with the rotor centerline 250. In comparison, with the present invention the gear case housing portion 112 between the end drum section 100 and the intermediate drum section 96 is positioned inboard of or offset from the rotor centerline 250. In other words, the centerline 252 for the gear case housing portion 112 is displaced inwardly toward the center of the machine and away from the centerline 250 of the rotor 56.

Upon extension of the end drum section 100, the drum moves the distance E. When fully extended the inner annular edge 108 of the extended drum section 100 is also advanced a distance E from its original position. Very little unmined area 254 is left at the mine floor beyond the cutting path of the end drum section 100 and the rotor 56.

The prior art arrangement is illustrated in FIG. 10 on the end drum section 98 and the rotor 54. When the end drum 98 is extended a distance A to a fully extended position, the inner annular edge 106 of the end drum 98 also moves the same distance, but a greater amount of unmined material 256 is left in place than the unmined material 254. This occurs because the gear case centerline 252 is vertically aligned with the rotor centerline 250. Thus, by positioning the gear case housings that rotatably support the end drum sections 98 and 100 inboard of the centerlines of the rotors 54 and 56, the entire end drums are extended to operate the lower cutter drum assembly 60 at its maximum length without reducing its efficiency in dislodging at the mine floor the portions left uncut by the rotors 54 and 56.

According to the provisions of the patent statutes, I have explained the principle, preferred construction, and mode of operation of my invention and have illustrated and described what I now consider to represent its best embodiments. However, it should be understood that, within the scope of the appended claims, the invention may be practiced otherwise than as specifically illustrated and described.

I claim:

1. A mining machine comprising, a mobile frame, said mobile frame having a front end portion, a rotor assembly including a plurality of rotor cutter arms rotatably mounted in spaced relation on said frame front end portion, a cutter drum assembly positioned forwardly of said frame front end portion and extending below said rotor assembly, said cutter drum assembly including an intermediate drum section and a pair of end drum sections, a drive shaft rotatably mounted transversely on said frame front end portion, said intermediate drum section and said pair of end drum sections positioned on said drive shaft, said end drum sections drivingly connected to said drive shaft for rotation of said end drum sections with said drive shaft, and said end drum sections being longitudinally movable on said drive shaft upon rotation of said drive shaft to extend the length of said cutter drum assembly.

2. A mining machine as set forth in claim 1 in which, said intermediate drum section is separated from each of said end drum sections on said drive shaft by a gap, a gear case pivotally mounted on said frame front end portion, said gear case including housing portions extending into said gaps, and said housing portions supporting said end drum sections for rotational and longitudinal movement on said frame front end portion.

3. A mining machine as set forth in claim 2 in which, said end drum sections are normally carried in a retracted position on said drive shaft for a minimum length of said cutter drum assembly, and said end drum sections upon rotation of said drive shaft being movable away from said housing portions to an extended position on said drive shaft.

4. A mining machine as set forth in claim 2 in which, said rotor assembly includes a pair of said rotor cutter arms extending in spaced parallel relation on said frame front end portion, said rotor cutter arms each having an axis of rotation defining a centerline extending longitudinally on said mobile frame, and said gear case housing portions each having a longitudinal centerline positioned inboard and laterally spaced from said centerlines of said rotor cutter arms, respectively.

5. A mining machine as set forth in claim 1 in which, said intermediate drum section is nonrotatably connected to said drive shaft, and said end drum sections are drivingly connected for rotation with said drive shaft and longitudinal movement on said drive shaft away from said intermediate drum section as said drive shaft rotates.

6. A mining machine as set forth in claim 5 in which, said end drum sections are movable on said drive shaft between a retracted position closely adjacent to said intermediate drum section and an extended position spaced from said intermediate drum section for increasing the width of a cutting operation executed by said cutter drum assembly.

7. A mining machine as set forth in claim 1 in which, said end drum sections are drivingly connected to said drive shaft through meshing helical splines including external helical splines extending in opposite helical directions on end portions of said drive shaft, said end drum sections being internally helically splined to mesh with said external helical splines of said drive shaft, and said end drum sections upon rotation of said drive shaft advance longitudinally away from one another on said drive shaft to extend the cutting path of said cutter drum assembly.

8. A mining machine as set forth in claim 1 which includes, piston cylinder assemblies extending between end portions of said drive shaft and said end drum sections respectively, one end of said piston cylinder assemblies being connected to said end drum sections and an opposite end positioned adjacent to said drive shaft end portions, and means for selectively applying a force to said opposite end of said piston cylinder assemblies to move said end drum sections between a retracted position and an extended position for adjusting the cutting path of said cutter drum assembly.

9. A mining machine as set forth in claim 8 in which, said end drum sections are maintained in said retracted position on said drive shaft by fluid force normally applied in a first direction against said opposite end of said piston cylinder assemblies to urge said end drum sections toward said intermediate drum section, and said end drum sections movable to said extended position by a fluid force applied in a second direction against said opposite end of said piston cylinder assemblies to move said end drum sections away from said intermediate drum section.

10. A mining machine as set forth in claim 1 which includes, a gear case for rotatably supporting said cutter drum assembly on said frame front end portion, said gear case including a clevis-type mounting, a first bracket positioned on said frame front end portion for pivotal connection to said clevis-type mounting for movement of said cutter drum assembly through a cutting path of a first diameter, a second bracket positioned on said frame front end portion spaced from said first bracket for pivotal connection to said clevis-type mounting for movement of said cutter drum assembly through a cutting path of a second diameter, and said gear case being selectively connected to said first and second brackets to adjust the diameter of the cutting path of said cutter drum assembly.

11. A method for extending the length of a cutter drum assembly on a mining machine comprising the steps of, rotatably supporting a drive shaft transversely on the front end of a mining machine, mounting an intermediate cutter drum section between a pair of end cutter drum sections on the drive shaft, drivingly connecting the intermediate cutter drum section and the end cutter drum sections to the drive shaft, transmitting rotation from the drive shaft to the intermediate cutter drum section and the end cutter drum sections to cut solid material from a mine face, and moving the end cutter drum sections on the drive shaft from a retracted position to an extended position by rotation of the drive shaft to extend the length of the cutter drum assembly and increase the width of the cut in a mine face.

12. A method as set forth in claim 11 which includes, drivingly connecting the end cutter drum sections on opposite sides of the intermediate cutter drum section to the drive shaft for rotational and longitudinal movement thereon, transmitting rotation through the drive shaft to the intermediate cutter drum section and the end cutter drum sections, and moving the end cutter drum sections longitudinally on the drive shaft away from the intermediate cutter drum section upon rotation of the drive shaft to expand the width of cut of solid material from the mine face.

13. A method as set forth in claim 11 which includes, connecting the end cutter drum sections to the drive shaft through meshing helical splines, and rotating the drive shaft to rotate the end cutter drum sections and advance the end cutter drum sections in opposite directions longitudinally on the drive shaft.

14. A method as set forth in claim 11 which includes, rotatably supporting a pair of rotor cutter arms in spaced relation on the front end of the mining machine, pivotally supporting a gear case to extend forwardly from the front end of the mining machine below the rotor cutter arms, positioning the end cutter drum sections on the drive shaft in spaced relation to the intermediate cutter drum section to form gaps therebetween, extending housing portions of the gear case into the gaps to rotatably support the drive shaft, and positioning longitudinal centerlines of the gear case housing portions inboard and laterally spaced from centerlines of the rotor cutter arms.

15. A method as set forth in claim 11 which includes, drivingly connecting the end cutter drum sections to the drive shaft by meshing helical splines, rotating the drive shaft for combined rotation and longitudinal movement of the end cutter drum sections on the drive shaft, longitudinally advancing the end cutter drum sections on the drive shaft as the drive shaft rotates, and restraining longitudinal movement of the end cutter drum sections on the drive shaft when the cutter drum assembly reaches a preselected length for cutting solid material from the mine face.

16. A mining machine comprising, a mobile frame, said mobile frame having a front end portion, a rotor assembly including a pair of rotor shafts rotatably supported in spaced parallel relation on said frame front end portion, said rotor shafts each including a centerline extending longitudinally on said mobile frame, a cutter drum assembly positioned forwardly of said frame front end portion and extending transversely thereto below the rotor shafts, said cutter drum assembly including an intermediate drum section and a pair of end drum sections, a drive shaft for rotatably supporting said intermediate drum section and said end drum sections, said intermediate drum section separated by gaps from said end drum sections on said drive shaft, a gear case extending forwardly from said frame front end portion into each gap for rotatably supporting said drive shaft on said mobile frame, said gear cases extending longitudinally on said mobile frame below said rotor shafts respectively, said gear cases each including a centerline positioned inboard of and laterally spaced from said rotor shaft centerlines, and said end drum sections positioned on said drive shaft for longitudinal movement toward and away from said gear cases to retract and extend the length of said cutter drum assembly.

17. A mining machine as set forth in claim 16 which includes, means for connecting said end drum sections to said drive shaft for combined rotation and longitudinally movement of said end drum sections.

18. A mining machine as set forth in claim 17 in which, said end drum sections are longitudinally movable on said drive shaft between a fully retracted position closely adjacent to said intermediate drum section and an extended position spaced from said intermediate drum section to increase the width of cut of the cutter drum assembly.

19. A mining machine as set forth in claim 18 which includes, means for restraining outward movement of said end drum sections upon rotation of said drive shaft to obtain a preselected width of cut of the cutter drum assembly.

20. A mining machine as set forth in claim 16 which includes, piston cylinder assemblies extending between end portions of said drive shaft and said end drum sections, said piston cylinder assemblies being connected at one end to said end drum sections and exerting a force at an opposite end upon said drive shaft end portions, and said piston cylinder assemblies being operable upon actuation to move said end drum sections between retracted and extended positions on said drive shaft to control the width of cut of the cutter drum assembly.

* * * * *